United States Patent [19]

Bush

[11] Patent Number: 4,927,341

[45] Date of Patent: May 22, 1990

[54] SCROLL MACHINE WITH RELIEVED FLANK SURFACE

[75] Inventor: James W. Bush, Sidney, Ohio

[73] Assignee: Copeland Corporation, Sidney, Ohio

[21] Appl. No.: 338,377

[22] Filed: Apr. 12, 1989

Related U.S. Application Data

[63] Continuation of Ser. No. 123,866, Nov. 23, 1987, abandoned.

[51] Int. Cl.[5] ..... F01C 1/04

[52] U.S. Cl. ..... 418/55

[58] Field of Search ..... 418/55, 55 A; 29/156.4 R

[56] References Cited

U.S. PATENT DOCUMENTS

| | | | |
|---|---|---|---|
| 3,473,728 | 10/1969 | Vulliez | 418/55 |
| 3,874,827 | 4/1975 | Young | 418/55 |
| 4,466,784 | 8/1984 | Hiraga | 418/55 |
| 4,490,099 | 12/1984 | Terauchi et al. | 418/5 |
| 4,666,380 | 5/1987 | Hirano et al. . | |
| 4,678,415 | 7/1987 | Hirano et al. . | |
| 4,678,416 | 7/1987 | Hirano et al. . | |

FOREIGN PATENT DOCUMENTS

| | | | |
|---|---|---|---|
| 57-62988 | 4/1982 | Japan | 418/55 |
| 58-172405 | 10/1983 | Japan | 418/55 |
| 59-142482 | 9/1984 | Japan . | |
| 61-226590 | 10/1986 | Japan | 418/55 |

*Primary Examiner*—John J. Vrablik

*Attorney, Agent, or Firm*—Harness, Dickey & Pierce

[57] ABSTRACT

A scroll compressor is disclosed in which either or both of the spiral wraps of the scroll members are reduced in thickness (i.e., cut away) adjacent to the inlet port defining the starting point the vanes would theoretically sealingly engage one another to initiate compression. Additionally, either or both of the spiral wraps of the scroll members may be reduced in thickness (i.e. cut away) adjacent to the discharge port where the vanes separate and the compression chambers defined thereby communicate with the discharge port. Provision of a smooth transition at the points of engagement cooperates to reduce noise and wear during operation of the compressor.

30 Claims, 3 Drawing Sheets

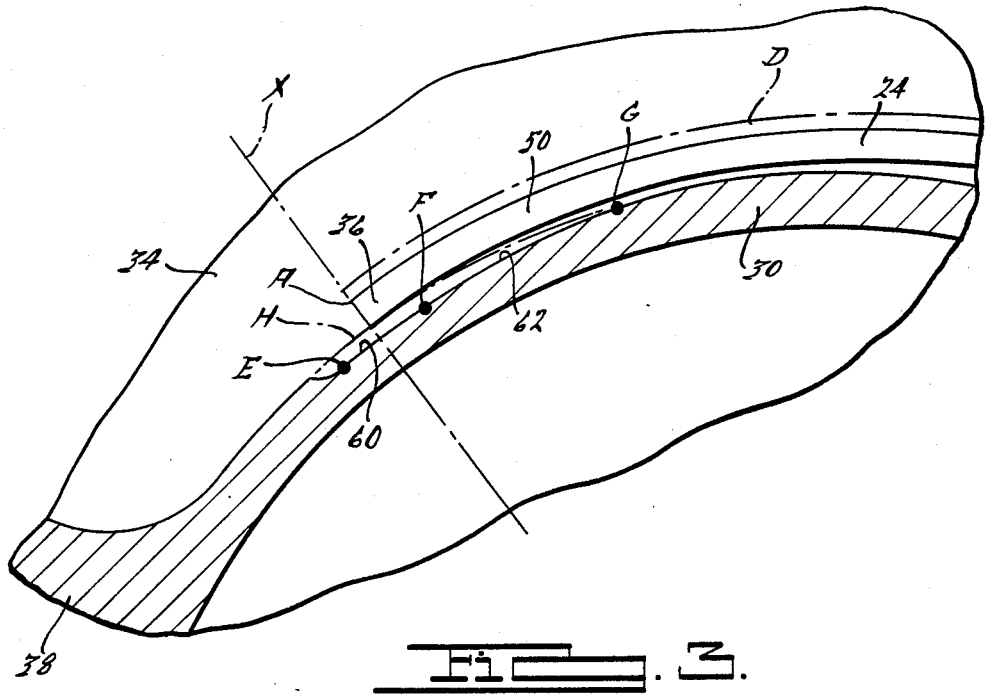
FIG. 3.
FIG. 4.
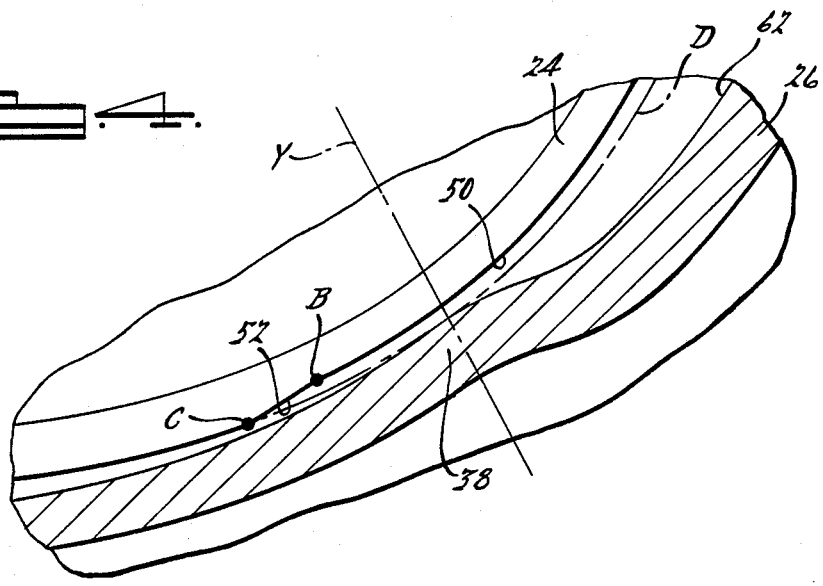

SCROLL MACHINE WITH RELIEVED FLANK SURFACE

This is a continuation of U.S. patent application Ser. No. 123,866, filed Nov. 23, 1987, now abandoned.

This invention relates to scroll-type machines and more particularly to a scroll wrap configuration which reduces scroll wrap noise and wear during operation of the machine.

Scroll machines generally comprise mated first and second scroll members each having an end plate on which is provided an upstanding spiral wrap interleaved with the wrap on the other scroll member; the wraps engaging each other at substantially line contacts so as to define traveling pockets of varying volume as one scroll member is caused to orbit relative to the other. The machine may be a pump, compressor or expander.

Some scroll machines have been found to have undesirable noise in operation. In trying to identify the noise it has been found during manufacture, machining forces can cause the outer free end of one or both of the spiral wraps to be deflected slightly radially outwardly. After machining, the free end springs back to its original position thus presenting a slightly misaligned projection which can cause undesirable engagement between the respective scroll wraps during relative orbital movement. Alternatively, when scroll wraps are machined into a solid surface with no free end on the wrap, tool deflection, rather than wrap deflection, can occur which has the same end result. This engaging contact not only can result in a banging noise but can contribute to wear of the scroll assembly, and possibly places additional loads on the crankshaft. Even if there is no distortion of the wrap end it is believed that this may be a relatively noisy area in the machine. Noise also can result from the sudden dynamic change in conditions at the point where the inner ends of the scroll wraps first communicate with the discharge port and/or separate from one another during operation.

The primary object of this invention therefore resides in the provision of a scroll-type machine which overcomes the aforementioned noise and wear problems in a simple and inexpensive manner which does not result in any significant loss of efficiency.

Other advantages and features of this invention will become apparent from the following specification taken in connection with the accompanying drawings.

BRIEF DESCRIPTION OF THE DRAWINGS

FIGS. 3 and 4 are enlarged fragmentary portions of FIG. 2 showing in an exaggerated form the outer ends of the functional portions of the wraps.

DESCRIPTION OF THE PREFERRED EMBODIMENT

Figure 1:
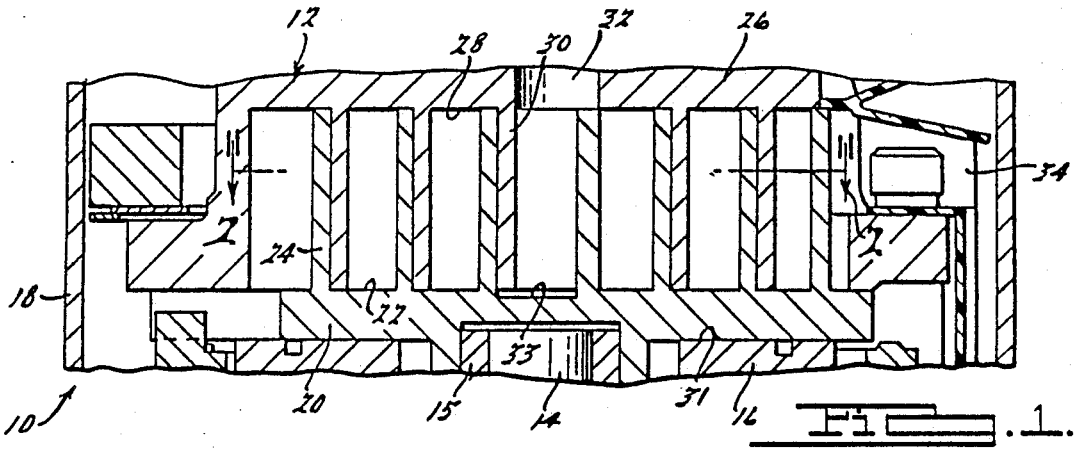
FIG. 1 is a fragmentary vertical section view of the scroll assembly of a hermetic scroll-type compressor embodying the principles of the present invention.
Figure 2:
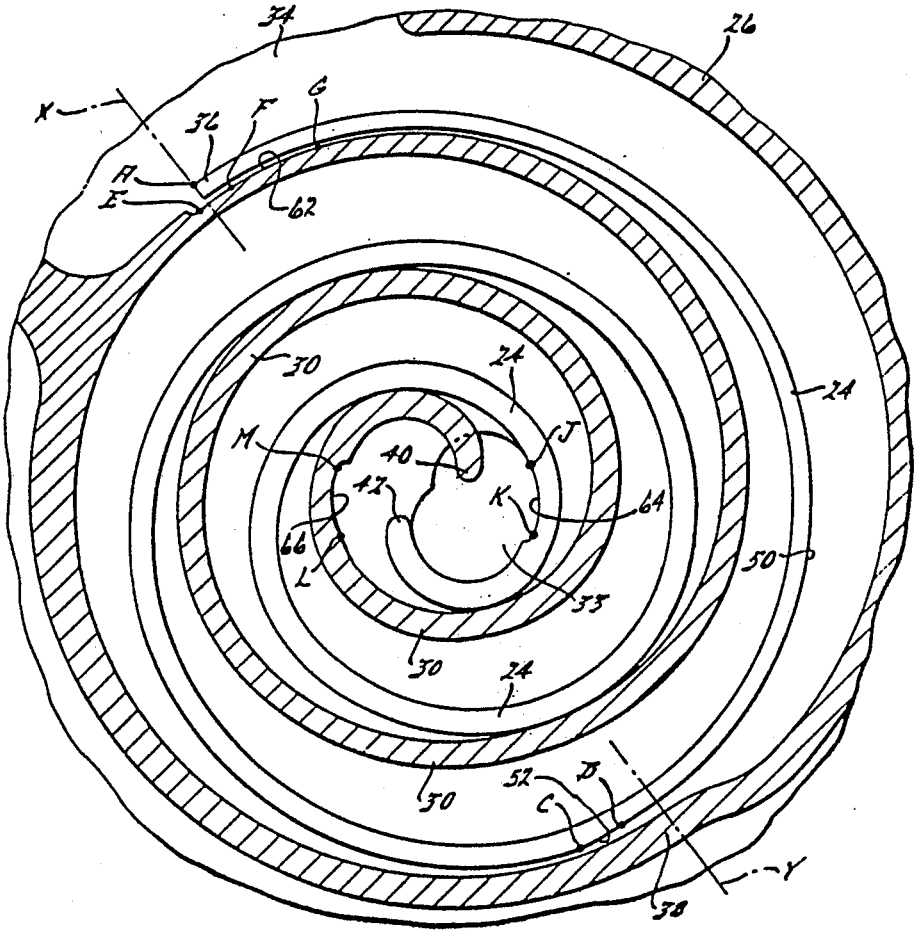
FIG. 2 is a rotated section view taken generally along line 2—2 of FIG. 1.
Figure 5:
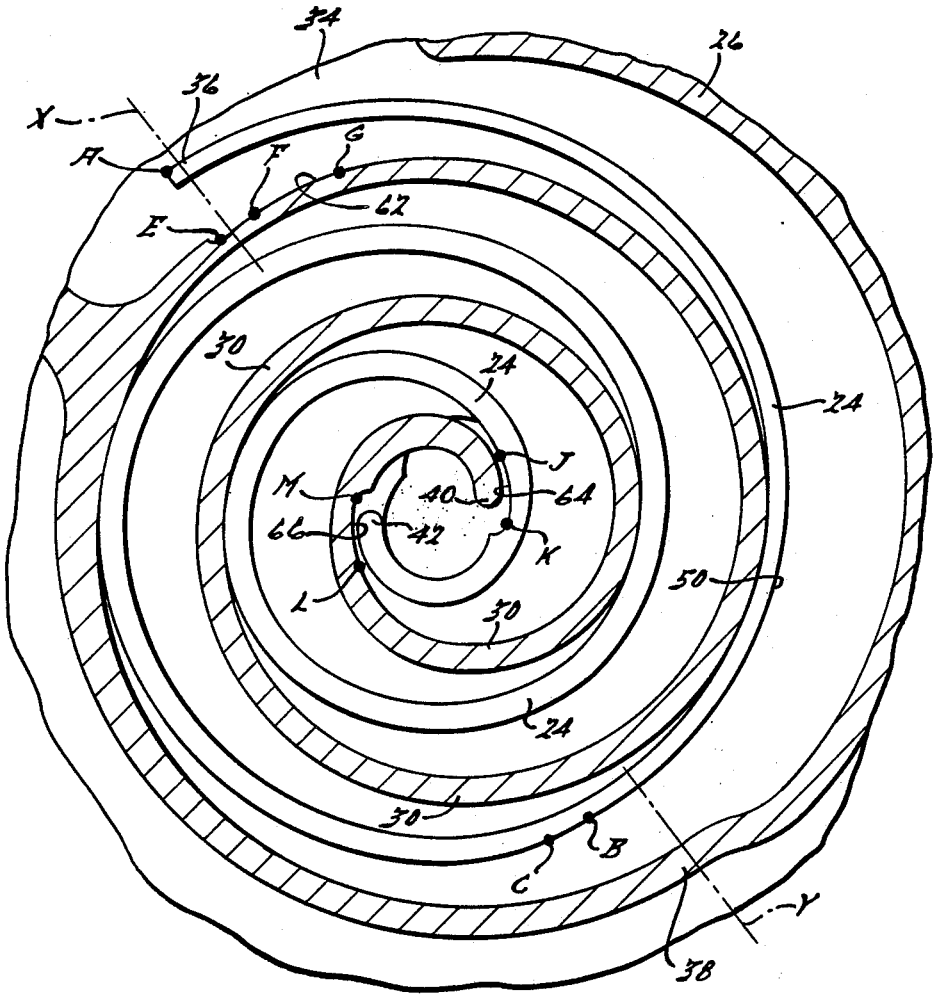
FIG. 5 is a fragmentary view similar to that of FIG. 1 but showing the orbiting scroll in an advanced position at the point the scroll wraps would separate absent the relieved surfaces.

Although the principles of the present invention may be applied to many different types of scroll-type machines, the discussion herein relates to a hermetic scroll-type machine including a pair of interfitting spiral vanes of equal shape (involutes of a circle) with one being non-orbiting and the other being orbitally driven by a crankshaft, which machine has specific utility in the compression of refrigerant for air conditioning and refrigeration. A machine of the present type is disclosed in assignee's pending application, Ser. No. 899,003, filed Aug. 22, 1986, now Pat. No. 4,767,293, entitled Scroll-Type Machine, the disclosure of which is expressly incorporated herein by reference.

An exemplary embodiment of a scroll compressor 10 according to the present invention comprises a scroll assembly 12 for compressing gases, a motor (not shown), a vertically disposed crankshaft including at one end thereof a crank pin 14 for drivingly interconnecting the scroll assembly to the motor via a drive bushing 15, a compressor body 16, and a shell 18 enclosing all of the above elements. The scroll assembly 12 includes an orbiting scroll member 20 including a scroll end plate 22 and a scroll wrap 24 of desired flank profile (e.g. an involute of a circle) upstanding thereform, and a non-orbiting scroll member 26 including a scroll end plate 28 and a scroll wrap 30 of similar flank profile upstanding therefrom, compressor body 16 supporting orbiting end plate 22 via the usual thrust surface 31. The scroll assembly also includes a central discharge port 32 in non-orbiting end plate 28, a similarly shaped fluid transfer recess 33 in orbiting scroll end plate 22 and a suction inlet port area 34.

The effective ends of wraps 24 and 30 are disposed on diametrically opposed axes "x" and "y", respectively, with the end of wrap 24 indicated at 36 and the end of wrap 30 at 38 (this wrap is continued outwardly and circumferentially to define a suction passage but this continued portion does not act as a wrap because it never engages the orbiting wrap). The inner end of non-orbiting wrap 30 is indicated at 40 and the inner end of orbiting wrap 24 is indicated at 42.

In accordance with this invention it has been discovered that the benefits sought can be obtained if the outer surface of each wrap is relieved in the area thereof where it would otherwise be engaged by the outer end of the other wrap. As shown, orbiting wrap 24 has a portion of its radially outwardly facing surface adjacent its radially outer free end 36 cut away or relieved to define a modified offset surface 50 staring at point "A" at the free end of the wrap and extending approximately 180° to 190° to a point "B" (just past axis "y") and then a ramp surface 52 tapering at a constant rate radially outwardly (approximately 20°) from point "B" to a point "C" whereupon the wrap surface assumes its normal involute shape. Phantom line "D" (FIG. 4) represents the outer flank surface of orbiting wrap 24 without being relieved in accordance with the present invention.

Similarly, non-orbiting wrap 30 has a modified offset surface 60 extending approximately 8° to 9° between points "E" and "F" and a ramp surface 62 tapering at a constant rate radially outwardly approximately 20° to 21° from point "F" to a point "G", the latter representing the point where wrap 30 is back to its original profile and thickness. Phantom line "H" (FIG. 3) represents the outer involute flank surface of nonorbiting wrap 30 without being relieved in accordance with this invention.

Modified surfaces 50 and 60 are easily formed by merely offsetting the wrap-machining cutter very slightly radially inwardly (e.g. 0.04 mm in a scroll having an orbiting wrap roughly 85 mm in overall outside diameter) to generate an offset surface parallel to the normal involute surface. Thus based upon the above exemplary dimensions, it can be determined that the ramp has a circumferential length equal to about 370 times the radial depth of the relieved surface. Leakage is minimal because the offset is so small and because this is a relatively low pressure zone in the machine.

It has been learned that additional benefits can be obtained by also relieving the wraps near the inner ends thereof. Thus, orbiting wrap 24 has a portion of its radially inwardly facing flank surface adjacent its radially inner free end 42 cut away or relieved to reduce wrap thickness. The removed portion defines a modified surface 64 which tapers at constant rate radially outwardly from a point "J" to a point "K". Similarly, non-orbiting wrap 30 has a portion of its radially inwardly facing flank surface adjacent its radially inner free end 40 cut away to reduce wrap thickness, the removed portion defining a modified surface 66 which tapers at constant rate radially outwardly from a point "L" to a point "M". Points "J" and "L" are located at a point disposed on the wrap flank surfaces slightly radially outwardly of the point of normal separation of the wraps, preferably at the point that discharge port 32 and recess 33 are opened. The configuration of the discharge port 32 (and corresponding recess 33) is disclosed in detail in assignee's application, Ser. No. 123,927, entitled Scroll Machine Center Port filed of even date in the name of Gary J. Anderson, now abandoned, the disclosure of which is expressly incorporated herein by reference. Points "K" and "M" are located slightly radially inwardly of the normal separation point of wraps if they had true involute flank surface. The resulting ramps, which are shown in greatly exaggerated form, smooth the transition from loading to unloading of the wrap ends. Leakage is not a problem in the ramped area because the discharge port is already opened.

Modifying the flank surfaces in the manner described has been found to reduce noise and wear, and it is believed that it will also allow the manufacturing process to be less precise and/or faster, and thus less expensive.

While it will be apparent that the preferred embodiments of the invention disclosed are well calculated to provide the advantages above stated, it will be appreciated that the invention is susceptible to modification, variation and change without departing from the proper scope or fair meaning of the subjoined claims.

What is claimed is:

1. A scroll type machine including first and second scroll members, each of said scroll members including an end plate having an outwardly projecting spiral wrap thereon, each of said wraps having active flank surfaces and radially inner tip end portions, and center and outer ports for receiving and discharging fluid, said wraps being interleaved with each other such that said active flank surfaces of said wraps interengage each other at a plurality of spaced locations so as to define a plurality of chambers therebetween such that when one of said scroll members is caused to orbit with respect to the other said scroll member said chambers will be caused to travel between said ports, whereby fluid received in one of said chambers through one of said ports if discharged through the other of said ports, the improvement comprising means defining a first relieved surface in the outer flank surface of one of said wraps, said relieved surface extending circumferentially inwardly along said flank surface from a point which is just circumferentially outwardly of the outer end of said flank surface on the other of said wraps which except for said relieved surface would be an active flank surface and a ramp surface extending radilly outwardly between the circumferentially inner end of said relieved surface and the adjacent active flank surface on said one wrap, said ramp surface extending circumferentially a distance substantially greater than the circumferential distance said relieved surface extends.

2. The machine as recited in claim 1 wherein said active flank surfaces have complimentary profiles, said relieved surface being radially inwardly offset and parallel to said profile.

3. Th machine as recited in claim 2 wherein said profile is the involute of geometric shape.

4. The machine as recited in claim 3 wherein said shape is a circle.

5. The machine as recited in claim 2 wherein said active flank surfaces have identical profiles.

6. The machine as recited in claim 1 wherein said ramp surface extends radially outwardly at a constant rate of change.

7. The machine as recited in claim 1 wherein the other of said wraps has means defining another relieved surface extending circumferentially inwardly along said flank surface from a point which is just circumferentially outwardly of the outer end of said flank surface on the one of said wraps which except for said relieved surface would be an active flank surface.

8. The machine as recited in claim 1 further comprising means defining a second relieved surface, said second relieved surface being disposed on the inner flank surface of one of said wraps adjacent the inner tip end thereof at the point of theoretical tip separation for the wrap active flank profile.

9. The machine as recited in claim 8, wherein said second relieved surface has a portion extending radially outwardly from said wrap surface.

10. The machine as recited in claim 9, wherein said surface portion extends radially outwardly at a constant rate of change.

11. A machine as recited in claim 10, wherein both of said wraps have said second relieved surface.

12. The machine as recited in claim 1 further comprising means defining a second relieved surface, said second relieved surface being disposed on the inner flank surface of one of said wraps adjacent the inner tip end thereof at the point at which the outer surface thereof first becomes exposed to the pressure of fluid in said center port during operation of said machine.

13. A machine as recited in claim 1 further comprising means defining a second relieved surface, said second relieved surface being disposed on the inner flank surface of one of said wraps adjacent the inner tip end thereof and extending approximately from the point of theoretical tip separation for the wrap active flank profile to the point at which the outer surface thereof first becomes exposed to the pressure of fluid in said center port during operation of said machine.

14. A machine as recited in claim 1 wherein said relieved surface extends through an arc of between 28° and 30° from said point.

15. A machine as recited in claim 14 wherein said relieved surface includes an offset portion extending from said point and a ramp portion extending between said offset portion and said active flank surface of said one of said ramps.

16. A machine as recited in claim 1 wherein said ramp surface extends circumferentially a distance at least twice the circumferential distance said relieved surface extends.

17. A machine as recited in claim 1 wherein said ramp surface extends circumferentially a distance equal to approximately 370 times the radial depth of said relieved surface.

18. A machine as recited in claim 1 wherein said ramp extends circumferentially over an angle of approximately 20 to 21 degrees.

19. A scroll type machine including first and second scroll members, each of said scroll members including an end plate having an outwardly projecting spiral wrap thereon, each of said wraps having active flank surfaces and radially inner tip end portions, and center and outer ports for receiving and discharging fluid, said wraps being interleaved with each other such that said active flank surfaces of said wraps interengage each other at a plurality of spaced locations so as to define a plurality of chambers therebetween such that when one of said scroll members is caused to orbit with respect to the other said scroll member said chambers will be caused to travel between said ports, whereby fluid received in one of said chambers through one of said ports is discharged through the other of said ports, the improvement comprising means defining a first relieved surface, said first relieved surface being disposed on the inner flank surface of one of said wraps adjacent to the inner tip end thereof at the point of theoretical tip separation for the wrap active flank profile and extending over the full height of said wrap and means defining a second relieved surface in the outer flank surface of one of said wraps, said second relieved surface extending circumferentially and radially inwardly along said outer flank surface from a point which is just circumferentially outwardly of the outer end of said flank surface on the other of said wraps which except for said relieved surface would be an active flank surface.

20. The machine as recited in claim 19, further comprising a ramp surface disposed between the circumferentially inner end of said second relieved surface and the adjacent active length surface on said one wrap.

21. A machine as recited in claim 20, wherein said ramp surface portion extends radially outwardly at a constant rate of change.

22. A machine as recited in claim 19, wherein both of said wraps have said second relieved surface.

23. A machine as set forth in claim 22 wherein both of said wraps have said first relieved surface.

24. A machine as recited in claim 19 further comprising a ramp surface extending radially outwardly between the circumferential inner end of said second relieved surface and the adjacent active flank surface on said wrap, said ramp surface extending radially outwardly at a constant rate of change.

25. A machine as recited in claim 19 further comprising a ramp surface extending radially outwardly between the circumferential inner end of said second relieved surface and the adjacent active flank surface on said one wrap, said ramp surface extending circumferentially a distance substantially greater than the circumferential distance of said relieved surface.

26. A machine as recited in claim 19 further including a ramp surface extending outwardly between the circumferential inner end of said relieved surface and the adjacent active flank surface on said one wrap, said ramp extending through an angle of approximately 20 to 21 degrees.

27. A scroll type machine including first and second scroll members, each of said scroll members including an end plate having an outwardly projecting spiral wrap thereon, each of said wraps having active flank surfaces and radially inner tip end portions, and center and outer ports for receiving and discharging fluid, said wraps being interleaved with each other such that said active flank surfaces of said wraps interengage each other at a plurality of spaced locations so as to define a plurality of chambers therebetween such that when one of said scroll members is caused to orbit with respect to the other said scroll member said chambers will be caused to travel between said ports, whereby fluid received in one of said chambers through one of said ports is discharged through the other of said ports, the improvement comprising means defining a first relieved surface in the outer flank surface of one of said wraps, said relieved surface extending circumferentially inwardly along said flank surface from a point which is just circumferentially outwardly of the outer end of said flank surface on the other of said wraps which except for said relieved surface would be an active flank surface and a ramp surface extending radially outwardly between the circumferential inner end of said relieved surface and the adjacent active flank surface on said one wrap, said ramp surface having a circumferential lenggth equal to at least a substantial multiple greater than one of the radial depth of said relieved surface.

28. A machine as recited in claim 27 wherein said substantial multiple is approximately 370.

29. A scroll type machine including first and second scroll members, each of said scroll members including an end plate having an outwardly projecting spiral wrap thereon, each of said wraps having active flank surfaces and radially inner tip end portions, and center and outer ports for receiving and discharging fluid, said wraps being interleaved with each other such that said active flank surfaces of said wraps interengage each other at a plurality of spaced locations so as to define a plurality of chambers therebetween such that when one of said scroll members is caused to orbit with respect to the other said scroll member said chambers will be caused to travel between said ports, whereby fluid received in one of said chambers through one of said ports is discharged through the other of said ports, the improvement comprising means defining a first relieved surface in the outer flank surface of one of said wraps, said relieved surface extending circumferentially inwardly along said flank surface from a point which is just circumferentially outwardly of the outer end of said flank surface on the other of said wraps which except for said relieved surface would be an active flank surface and a ramp surface extending radially outwardly between the circumferential inner end of said relieved surface and the adjacent active flank surface on said wrap, said ramp surface extending radially outwardly at a constant rate of change.

30. A scroll type machine including first and second scroll members, each of said scroll members including an end plate having an outwardly projecting spiral wrap thereon, each of said wraps having active flank surfaces and radially inner tip end portions, and center and outer ports for receiving said discharging fluid, said wraps being interleaved with each other such that said active flank surfaces of said wraps interengage each other at a plurality of spaced locations so as to define a plurality of chambers therebetween such that when one of said scroll members is caused to orbit with respect to the other said scroll member said chambers will be caused to travel between said ports, whereby fluid received in one of said chambers through one of said ports is discharged through the other of said ports, the improvement comprising means defining a first relieved surface in the outer flank surface of one of said wraps, said relieved surface extending circumferentially inwardly along said flank surface from a point which is just circumferentially outwardly of the outer end of said flank surface on the other of said wraps which except for said relieved surface would be an active flank surface and a ramp surface extending outwardly between the circumferential inner end of said relieved surface and the adjacent active flank surface on said one wrap, said ramp extending through an angle of approximately 20 to 21 degrees.

* * * * *

UNITED STATES PATENT AND TRADEMARK OFFICE

CERTIFICATE OF CORRECTION

PATENT NO. : 4,927,341

DATED : May 22, 1990

INVENTOR(S) : James W. Bush

It is certified that error appears in the above-identified patent and that said Letters Patent is hereby corrected as shown below:

Column 1, line 22, after "found" insert -- that --.

Column 2, line 22, "thereform" should be -- therefrom --.

Column 3, lines 35 and 36, "surface" should be -- surfaces --.

Column 3, line 67, "if" should be -- is --.

Column 4, line 9, "radilly" should be -- radially --.

Column 5, line 36, delete "to".

Column 6, line 38, "lenggth" should be -- length --.

Column 7, line 11 (first occurrence), "said" should be -- and --.

Signed and Sealed this

Twenty-ninth Day of September, 1992

*Attest:*

*Attesting Officer*

DOUGLAS B. COMER

*Acting Commissioner of Patents and Trademarks*